US006723208B1

(12) United States Patent
Hansen

(10) Patent No.: US 6,723,208 B1
(45) Date of Patent: Apr. 20, 2004

(54) METHOD FOR PRODUCING SPIRAL WOUND PAPER MACHINE CLOTHING

(75) Inventor: Robert A Hansen, Stuttgart-Birkach (DE)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/679,697

(22) Filed: Oct. 5, 2000

(51) Int. Cl.[7] ..... D21F 7/08

(52) U.S. Cl. ..... 162/358.2; 162/900; 162/901; 162/902; 162/903; 28/110; 28/142; 442/185; 442/270; 442/271; 156/192; 156/195; 156/137; 139/383 A

(58) Field of Search ..... 162/348, 358.2, 162/900–903; 28/110, 142; 442/185, 271, 270; 156/192, 195, 137; 139/383 A

(56) References Cited

U.S. PATENT DOCUMENTS

| | | | | |
|---|---|---|---|---|
| 2,225,026 A | * | 12/1940 | Welsh | 156/192 |
| 2,315,217 A | * | 3/1943 | Obliglio | 156/195 |
| 3,673,024 A | * | 6/1972 | Eriksson | 156/192 |
| 4,427,734 A | | 1/1984 | Johnson | 428/234 |
| 5,268,076 A | * | 12/1993 | Best et al. | 162/358.2 |
| 5,360,656 A | | 11/1994 | Rexfelt et al. | 428/193 |
| 5,525,410 A | | 6/1996 | Hansen | 428/229 |
| 5,785,818 A | * | 7/1998 | Fekete et al. | 162/358.2 |
| 5,939,176 A | * | 8/1999 | Yook | 162/358.2 |
| 6,124,015 A | * | 9/2000 | Baker et al. | 428/99 |

FOREIGN PATENT DOCUMENTS

| | | |
|---|---|---|
| EP | 0 464 258 A1 | 1/1992 |
| EP | 0 665 329 A1 | 8/1995 |
| EP | 0 802 280 A2 | 10/1997 |
| EP | 1 063 349 A2 | 12/2000 |
| WO | WO 98/58120 | 12/1998 |

* cited by examiner

*Primary Examiner*—Peter Chin
(74) *Attorney, Agent, or Firm*—Frommer Lawrence & Haug LLP; Ronald R. Santucci

(57) ABSTRACT

A papermaker's fabric is manufactured by spirally winding a laminated structure in a plurality of turns. The laminated structure has a bottom layer and a top layer, both of which are strips having a common width. The bottom layer and the top layer are laminated to one another in a transversely offset manner, so that an unlaminated portion of the bottom layer is along one lateral edge of the laminated structure and an unlaminated portion of the top layer is along the other lateral edge. When the laminated structure is spirally wound, the unlaminated portion of the top layer in one turn overlies the unlaminated portion of the bottom layer in an adjacent turn. These are joined to one another to form the papermaker's fabric from the spirally wound structure.

27 Claims, 5 Drawing Sheets

METHOD FOR PRODUCING SPIRAL WOUND PAPER MACHINE CLOTHING

BACKGROUND OF THE INVENTION

1. Field of the Invention

The present invention relates to the papermaking arts. More specifically, the present invention relates to the manufacture of paper machine clothing, that is, to the fabrics used on the forming, pressing and drying sections of a paper machine.

2. Description of the Prior Art

During the papermaking process, a cellulosic fibrous web is forced by depositing a fibrous slurry, that in, an aqueous dispersion of cellulosic fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web in subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at Least one series of rotatable dryer drum or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming, fabric in the forming section, while a newly manufactured paper sheet is continuously wound onto rolls after it exits from the dryer section.

The present invention relates to the press fabrics used in the press section, but way also be applied to the manufacture of forming and dryer fabrics for the forming and drying sections, respectively, of a paper machine. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of fine, nonwoven fibrous material. The base fabrics may be woven from monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a papermachine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join then to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, an each press fabric must typically be made to order.

In response to thin need to produce press fabrics in a variety of lengths and widths more quickly and efficiently, press fabrics have been produced in recant years using a spiral technique disclosed in commonly assigned U.S. Pat. No. 5,360,656 to Rexfelt et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting or welding. Alternatively, adjacent longitudinal edge portions of adjoining spiral turns may be arranged overlappingly, so long as the edges have a reduced thickness, so as not to give rise to an increased thickness in the area of the overlap. Further, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (cross-machine)) direction, is the result. The lateral edges of the woven base fabric are then trimmed to render them parallel to its longitudinal (machine) direction. The angle between the machine direction of the woven base fabric and the helically continuous seam may be relatively small, that is, typically lees than ion. By the same token, the lengthwise (warp) yarns of the woven fabric strip make the same relatively snail angle with the longitudinal (machine) direction of the woven base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filing) yarns of the woven fabric strip align with the longitudinal (machine) or transverse (cross-machine) directions of the woven base fabric.

In the method shown in U.S. Pat. No. 5,360,656, the woven fabric strip in wound around two parallel rolls to assemble the woven base fabric, it will be recognized that endless base fabrics in a variety of widths and lengths may be provided by spirally winding a relatively narrow piece of woven fabric strip around the two parallel rolls, the length of a particular endless base fabric being determined by the length of each spiral turn of the woven fabric strip, and the width being determined by the number of spiral turns of the woven fabric strip. The prior necessity of weaving complete base fabrics of specified lengths and widths to order may thereby be avoided. Instead, a loom as narrow as 20 inches (0.5 meters) could be used to produce a woven fabric strip, but, for reasons of practicality, a conventional textile loom having a width of from 40 to 60 inches (1.0 to 1.5 meters) may be preferred.

U.S. Pat. No. 5,360,656 also shows a press fabric comprising a base fabric having two layers, each composed of a spirally wound strip of woven fabric. Both layers take the form of an endless loop, one being inside the endless loop formed by the other Preferably, the spirally wound strip of woven fabric in one layer spirals in a direction opposite to that of the strip of woven fabric in the other layer. That is to say, more specifically, the spirally wound strip in one layer defines a right-handed spiral, while that in the other layer defines a left-handed spiral, in such a two-layer, laminated base fabric, the lengthwise (warp) yarns of the woven fabric strip in each of the two layers make relatively small angles with the longitudinal (machine) direction of the woven base fabric, and the lengthwise (warp) yarns of the woven fabric strip in one layer make an angle with the lengthwise (warp) yarns of the woven fabric strip in the other layer. Similarly, the crosswise (filling) yarns of the woven fabric strip in each of the two layers make relatively small angles with the transverse (cross-machine) direction of the woven base fabric, and the crosswise (filling) yarns of the woven fabric strip in one layer make an angle with the crosswise (filling) yarns of the woven fabric strip in the other layer. In short, neither the lengthwise (warp) nor the crosswise (filling) yarns of the woven fabric strip in either layer align with the longitudinal (machine) or transverse (cross-machine) directions of the base fabric. Further, neither the lengthwise (warp) nor the crosswise (filling) yarns of the woven fabric strip in either layer align with those of the other.

An a consequence, the bass fabrics shown in U.S. Pat. No. 5,360,656 have no defined machine- or cross-machine-direction yarns. Instead, the yarn systems lie in directions at oblique angles to the machine and cross-machine directions. A press fabric having such a base fabric may be referred to as a multi-axial press fabric. Whereas the standard press fabrics of the prior art have three axes: one in the machine direction (MD) one in the cross-machine direction (CD) and one in the Z-direction, which is through the thickness of the fabric, a multi-axial press fabric has not only these three axes, but also has at least two more axes defined by the directions of the yarn systems in its spirally wound layer or layers. Moreover, there are multiple flow paths in the Z-direction of a multi-axial press fabric. As a consequence, a multi-axial press fabric has at least five axes. Because of its multi-axial structure, a multi-axial press fabric having more than one layer exhibits superior resistance to nesting and/or to collapse in response to compression in a press nip during the papermaking process as compared to one having base fabric layers whose yarn systems are parallel to one another.

Once a base fabric has been manufactured in accordance with the teachings of U.S. Pat. No. 5,360,656, other materials may be attached thereto in the form of additional layers. Most often, these additional layers comprise batts of staple fiber material attached to the base fabric by needling or hydroentangling. The staple fiber material forms the paper-supporting surface of the press fabric, and, where the base fabric has been laminated, individual fibers which have been driven through the laminated base fabric by the needling or hydroentangling are the means by which the layers are held together.

Moreover, layers of additional materials, such as apertured thermoplastic sheet material or nonwoven mesh fabrics, are frequently used to cover the base fabric before batts of staple fiber material are attached thereto. These additional materials are included, for example, to provide enhanced compressibility and resiliency, additional void volume for the temporary storage of water pressed from a paper web or a smoother, knuckle-free surface.

Clearly, the provision of these additional layers is made at the expense of additional manufacturing steps which, in the long run, use up much of the time saved by manufacturing the bass fabric according to the teachings of U.S. Pat. No. 5,360,656. The present invention provides a mans by which a laminated papermaker's fabric may be manufactured more efficiently from a previously laminated structure in accordance with the teachings of this same patent.

SUMMARY OF THE INVENTION

Accordingly, the present invention is both a method for manufacturing a papermaker's fabric, and the papermaker's fabric itself, wherein a laminated structure in the form of a strip is premanufactured and subsequently used to fashion papermaker's fabrics in specified widths and lengths using a spiral winding technique.

The laminated structure comprises a top layer and a bottom layer, which are attached to one another in a sandwich-like fashion, both the top layer and the bottom layer are of a common width, are in the form of strips and are laminated to one another in a transversely offset manner. As a consequence, an unlaminated portion of the bottom layer is along one lateral edge of the laminated structure and an unlaminated portion of the top layer is along the other lateral edge.

When the laminated structure is spirally wound, the unlaminated portion of the top layer in one turn of the spirally wound laminated structure overlies the unlaminated portion of the bottom layer in an adjacent turn. The overlying unlaminated portion of the top layer is then joined to the unlaminated portion of the bottom layer to produce the papermaker's fabric. Such a joint improves the structural integrity and dimensional stability of the papermaker's fabric, and is less likely to mark a paper web than one made along a single line.

The top layer, which ultimately supports a paper web on a paper machine, comprises one of the materials selected from the group consisting of: staple fiber material; fabric woven from fibers or filaments fine enough not to mark a wet paper web; spun-bond, hydroentangled and melt-blown nonwoven fabrics; and apertured extruded polymeric films. The bottom layer comprises one of the materials selected from the group consisting of: staple fiber material; fabric woven from fibers or filaments fine enough not to mark a wet paper web; spun-bond, hydroentangled and melt-blown nonwoven fabrics; apertured extruded polymeric films; knitted fabrics; nonwoven netting materials or mesh fabrics; and woven fabric strips. The top and bottom layers are attached to one another by sewing, needling, melting, fusing, gluing or the like, and the resulting laminated structure stored for subsequent use in manufacturing papermaker's fabrics.

The present invention will now be described in more complete detail with frequent reference being made to the figures identified below.

DETAILED DESCRIPTION OF THE PREFERRED EMBODIMENTS

Figure 1:
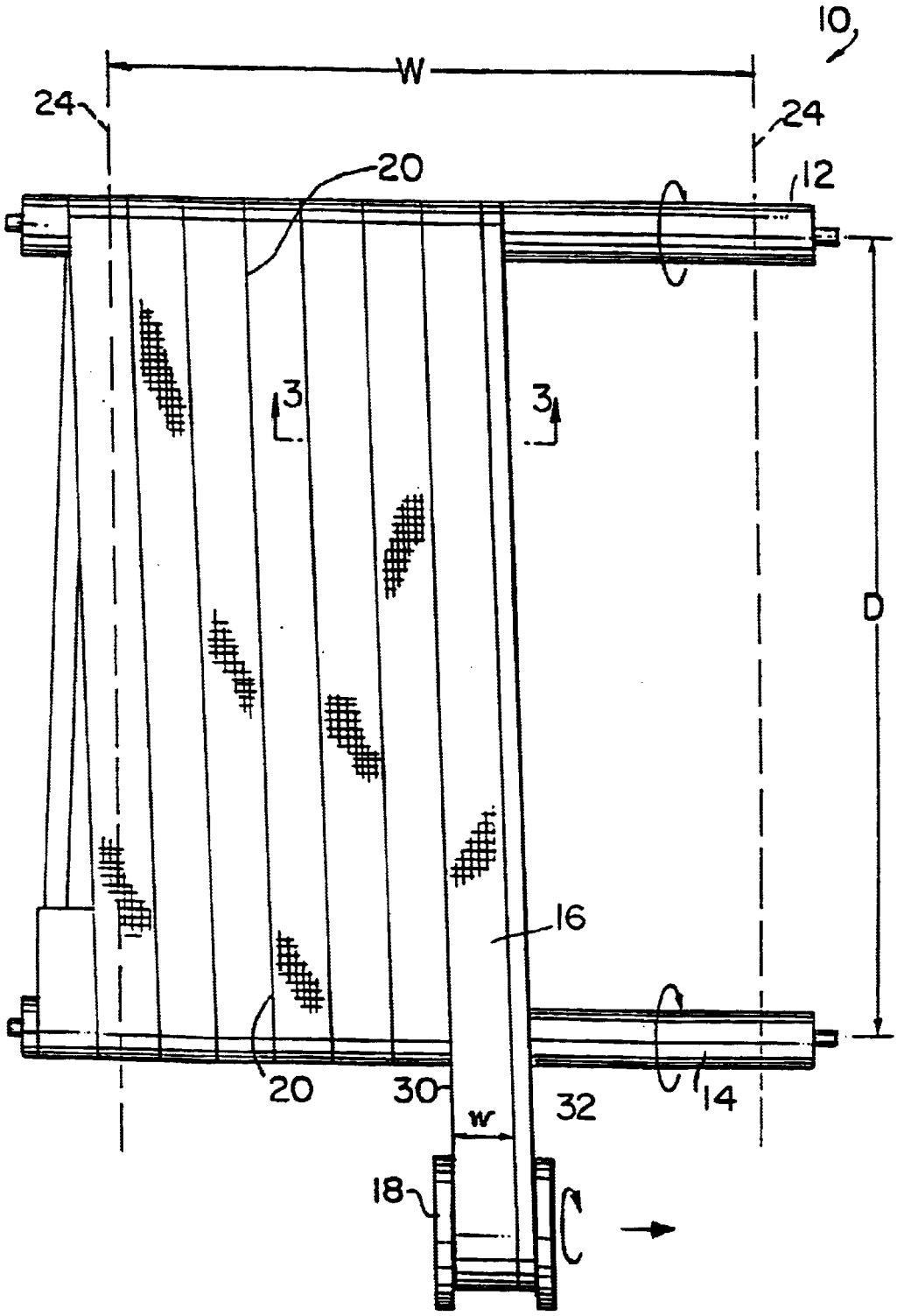
FIG. 1 is a schematic top plan view illustrating a method for manufacturing the papermaker's fabric of the present invention.

Referring now to these figures, FIG. 1 is a schematic top plan view illustrating the present method for manufacturing a papermaker's fabric. The method may be practiced using an apparatus 10 comprising a first roll 12 and a second roll 14, which are parallel to one another and which may be rotated in the direction indicated by the arrows. A laminated structure 16 in the form of a strip is wound from a stock roll 18 around the first roll 12 and the second roll 14 in a continuous spiral. It will be recognized that it may be necessary to translate the stock roll 18 at a suitable rate along second roll 14 (to the right in FIG. 1) as the laminated structure 16 is being wound around the rolls 12,14.

Figure 2:
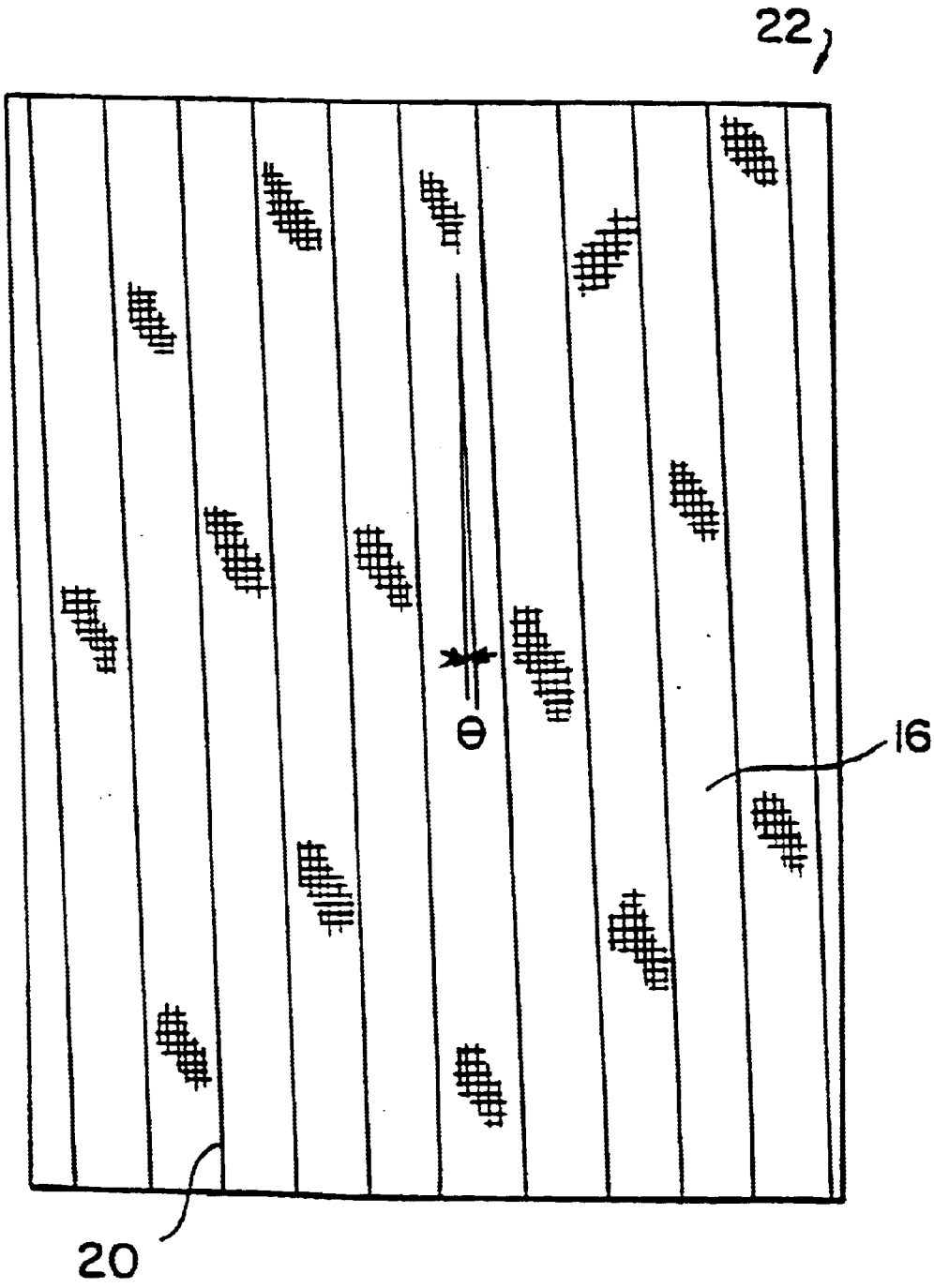
FIG. 2 is a top plan view of the papermaker's fabric.

The first roll 12 and the second roll 14 are separated by a distance, D, which is determined with reference to the total length, C, required for the papermaker's fabric being manufactured, the total length, C, being measured longitudinally (in the machine direction) about the endless-loop form of the papermaker's fabric. Laminated structure 16 is spirally wound onto the first and second rolls 12,14 in a plurality of turns from stock roll 18, which may be translated along the second roll 14 in the course of the winding. Successive turns of the laminated structure 16 are abutted against one another and are attached to one another along helically continuous seam 20 by sewing, stitching, melting, gluing or welding to produce papermaker's fabric 22 as shown in FIG. 2. Such attachment may be effected on either the inside or the outside of the endless loop formed by the papermaker's fabric 22, attachment on the inside being preferred. When a sufficient number of turns of the laminated structure 16 have been made to produce papermaker's fabric 22 in the desired width, W, that width being measured transversely (in the cross-machine direction) across the endless-loop form of the papermaker's fabric 22, the spiral winding is concluded. The papermaker's fabric 22 so obtained has an inner surface, an outer surface, a machine direction and a cross-machine direction. Initially, the lateral edges of the papermaker's fabric 22, it will be apparent, will not be parallel to the machine direction thereof, and must be tried along lines 24 to provide the press fabric 22 with the desired width, W, and with two lateral edges parallel to the machine direction of its endless-loop form.

Because laminated structure 16 is spirally wound to assemble papermaker's fabric 22, helically continuous seam 20 does not align with the longitudinal, or machine, direction of the press fabric 22, but instead makes a slight angle, θ, whose magnitude is a measure of the pitch of the spiral windings of the laminated structure 16 with respect to the machine direction of the papermaker's fabric 22, as suggested by the top plan view thereof shown in FIG. 2. This angle, as previously noted, is typically lose than 10°.

Figure 3:
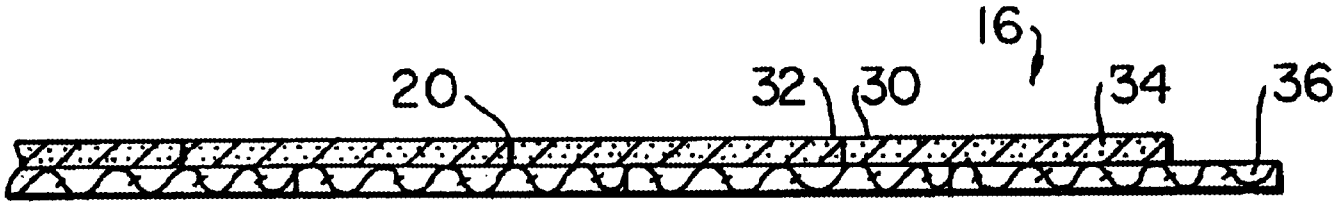
FIG. 3 is a cross section taken as indicated by line 3—3 in FIG. 1.
Figure 4:
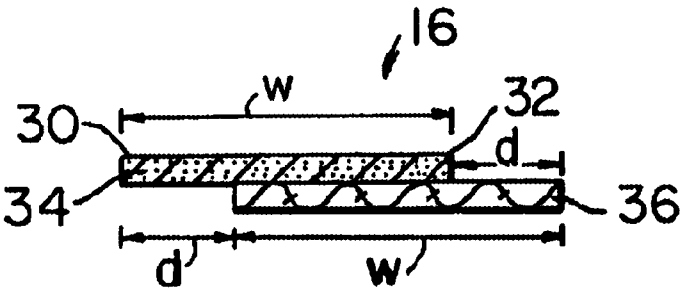
FIG. 4 is a cross-sectional view of the laminated structure from which the present invention is manufactured.

FIG. 3 is a cross section taken as indicated by line 3—3 in FIG. 1, and FIG. 4 is a cross-sectional view of laminated structure 16. As may be observed in FIGS. 3 and 4, laminated structure 16 comprises two layers, which, for the sake of convenience, will be identified as a top layer 34 and a bottom layer 36. It should be appreciated and understood that the top layer 34 forms the outer surface of papermaker's fabric 22 and contacts the wet paper web being manufactured on the paper machine.

As indicated above, top layer 34 comprises one of the materials selected from the group consisting of: staple fiber material; fabric woven from fibers or filaments fine enough not to mark a wet paper web; spun-bond, hydroentangled and melt-blown nonwoven fabrics; and apertured extruded polymeric films. Moreover, top layer 34 may comprise at least two distinct sublayers, each of which comprises one of the materials selected from this same group.

For example, top layer 34, or a sublayer thereof, may comprise a batt or batts of staple fiber material.

Alternatively, top layer 34, or a sublayer thereof, may comprise a fabric, either woven or nonwoven, of fine yarns or filaments of a denier comparable to that of batt fiber and therefore not likely to seriously mark a wet paper web with which it comes into contact.

As such, top layer 34, or a sublayer thereof, may be a fine woven fabric of the variety disclosed in commonly assigned U.S. Pat. No. 5,525,410, the teachings of which are incorporated herein by reference. Alternatively, fine woven mesh products such as those produced and sold by Kanebo may also be used. Spun-bond nonwoven fabrics available from Cerex, and hydroentangled nonwoven fabrics available from Dupont under the name Sontara, may also be used. The latter materials are hydroentangled, very fine denier, polyester fiber materials. The melt-blown nonwoven fabrics of interest normally include polypropylene or polyethylene.

The top layer 34, or a sublayer thereof, may also comprise an apertured extruded polymeric film, such as apertured thermoplastic polyurethane (TPU) sheet material. The apertured TPU sheet material may have a density or from 140 to 850 g/m$^2$, a thickness of from 0.13 to 1.3 mm (5 to 50 mil), and a percent open area of from 20% to 60%. The apertures may have any shape, such as rectangular, square, circular and so forth. Alternatively, the polymeric film may be of polyamide, polyethylene or polypropylene.

The bottom layer 36 comprises one of the materials selected from the group consisting of the materials identified as being suitable for the top layer 34, plus knitted fabrics, nonwoven netting materials or mesh fabrics; and woven fabric strips. One or more of these last three materials (knitted fabrics; nonwoven netting materials or mesh fabrics; and woven fabric strips) are included when the bottom layer 36 is to carry out a load-bearing function on the paper machine and is to provide the papermaker's fabric with dimensional stability in both the machine and cross-machine directions. Moreover, bottom layer 36 may comprise at least two distinct sublayers, each of which comprises one of the materials selected from this same group.

As such, the bottom layer 36, or a sublayer thereof, may comprise a woven fabric strip, which may be woven from monofilament, plied monofilament or multifilament yarns of a synthetic polymeric resin, such as polyamide or polyester, in the same manner as other fabrics used in the papermaking industry are woven. After weaving, the woven fabric strip may be heat-set in a conventional manner prior to interim storage on a stock roll. Such a woven fabric strip includes lengthwise yarns and crosswise yarns, wherein, for example, the lengthwise yarns may be plied monofilament yarns while the crosswise yarns may be monofilament yarns, and may be of a single- or multi-layer weave. As above, the woven fabric strip may be a fine woven fabric of the variety disclosed in commonly assigned U.S. Pat. No. 5,525,410, or a fine woven mesh fabric of the variety sold by Kanebo.

Alternatively, the bottom layer 36, or a sublayer thereof, may comprise a strip of nonwoven mesh fabric of the variety disclosed in commonly assigned U.S. Pat. No. 4,427,734 to Johnson, the teachings of which are incorporated herein by reference. The nonwoven mesh fabric disclosed in this U.S. patent has a net-like structure of ribs or yarns defining a mesh. The monofilament-like elements making up the nonwoven mesh fabric are oriented in the lengthwise and crosswise directions thereof, although, alternatively, they may be oriented diagonally with respect to those directions. The nonwoven mesh fabric is fabricated by extrusion or like techniques from thermoplastic resins, such as polyamide, polypropylene, polyethylene and the like. For example, nonwoven netting material available from Naltex and having strands with diameters in the range from 0.33 mm (0.013 inches or 13 mil) to 2.03 mm (0.080) inches or 80 mil) and counts of 3 to 16 strands per centimeter (7 to 40 strands per inch) may be used for this purpose. These materials are made from polyamide, polyester, polypropylene and polyethylene.

The top layer 34 and bottom layer 36 are joined to one another to form the laminated structure 16 used to manufacture papermaker's fabric 22. Both the top layer 34 and the bottom layer 36 are in the form of a strip of width, w. That is to say, the top layer 34 has a width, w, equal to that of the bottom layer 36. Preferably, the width, w, is nominally 1.0 meter (39.4 inches), although strips having widths anywhere in a range from 1.0 mm (0.001 m; 0.039 inch) to 5.0 meters (197.0 inches) may prove to be useful in the practice of the present invention.

The top layer 34 is joined to the bottom layer 36 such that they are transversely offset from one another by a distance, d. Joining is effected by sewing, needling, fusing, melting, gluing or other processes well-known by those of ordinary skill in the art for joining fabric layers to one another. Considerable lengths of the laminated structure 16 may be manufactured and set aside for subsequent use in manufacturing papermaker's fabric 22 to the size specifications required by customers.

Referring again to FIG. 4, the top layer 34 of laminated structure 16 has a first lateral edge 30 and a second lateral edge 32 which together define its width, w. The bottom layer 36, as previously noted, has the same width, w. As the laminated structure 16 is being spirally wound onto first and second rolls 12,14 to assemble the structure shown in cross section in FIG. 3, the first lateral edge 30 of top layer 34 of each turn of the laminated structure 16 is abutted against the second lateral edge 32 of top layer 34 of the immediately preceding turn. In so doing, the lateral edges of the bottom layer 36 also abut in the same manner. Because of the offset of the top layer 34 relative to the bottom layer 36 by distance, d, each turn of the laminated strip 16 forms a lap joint with the preceding turn, because a portion, of width, d, of top layer 34 of one turn overlies a portion of the same width of the preceding turn of bottom layer 36. The overlapping portions of top layer 34 are then joined to the underlying portions of bottom layer 36 by sewing, stitching, melting, gluing or welding to produce the papermaker's fabric 22 as shown in FIG. 2. The attachment may be effected on either the inside or the outside of the endless loop formed by the papermaker's fabric 22, attachment on the inside being preferred.

With the present invention, the need to bond full-width structures to one another to produce a laminated structure may be avoided. Instead, the laminated structure is first manufactured from top and bottom layers of a relatively narrow width, and subsequently used to assemble full-width structures by a spiral winding technique. The laminated structure may be manufactured quickly and later used for this purpose.

Modifications to the above would be obvious to one of ordinary skill in the art, but would not bring the invention so modified beyond the scope of the appended claims.

Figure 5:
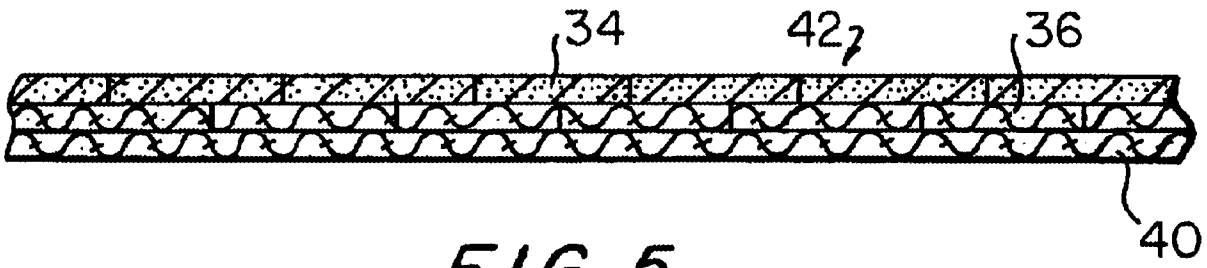
FIG. 5 is a cross-sectional view taken transversely across a first alternate embodiment of the papermaker's fabric of the present invention.
Figure 6:
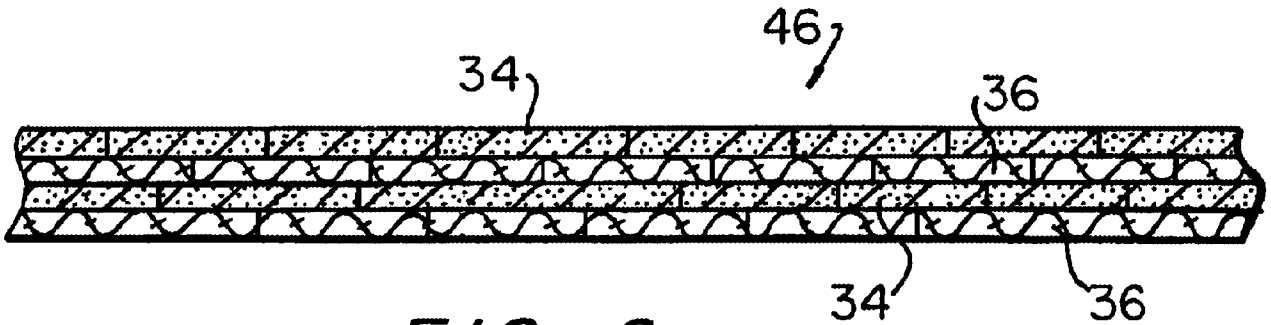
FIG. 6 is a cross-sectional view, analogous to that given in FIG. 5, of a second alternate embodiment of the present invention.

For example, a laminated papermaker's fabric, incorporating papermaker's fabric 22 manufactured in the foregoing manner from laminated structure 16, may itself be manufactured by first mounting a base fabric 40 of any of the standard varieties described above about first and second rolls 12,14, and by then spirally winding a strip of laminated structure 16 thereonto to produce a layer in the form of papermaker's fabric 22 on top of the base fabric 40 in accordance with the procedure described above. A cross-sectional view taken transversely across such a laminated papermaker's fabric 42 is shown in FIG. 5. Alternatively, or additionally, a further layer in the form of papermaker's fabric 22 may be manufactured by spirally winding a strip of laminated structure 16 onto that previously produced by spiral winding in accordance with the procedure described above. A cross-sectional view taken transversely across such a laminated papermaker's fabric 44 is shown in FIG. 6. Preferably, such a layer would be manufactured by spirally winding the strip of laminated structure 16 in a direction opposite to that in which it was wound to produce the previous layer, so that in one layer the laminated structure 16 would spiral in one direction, producing a right-handed spiral, while in the other layer the laminated structure 16 would spiral in the other direction, producing a left-handed spiral.

Moreover, a laminated papermaker's fabric, incorporating papermaker's fabric 22 manufactured, in the above-described manner from laminated structure 16, and having the same appearance as the laminated papermaker's fabric 42 shown in FIG. 5, may also be manufactured by slipping papermaker's fabric 22 over a base fabric of any of the standard varieties described above and having suitably matched dimensions.

Figure 7:
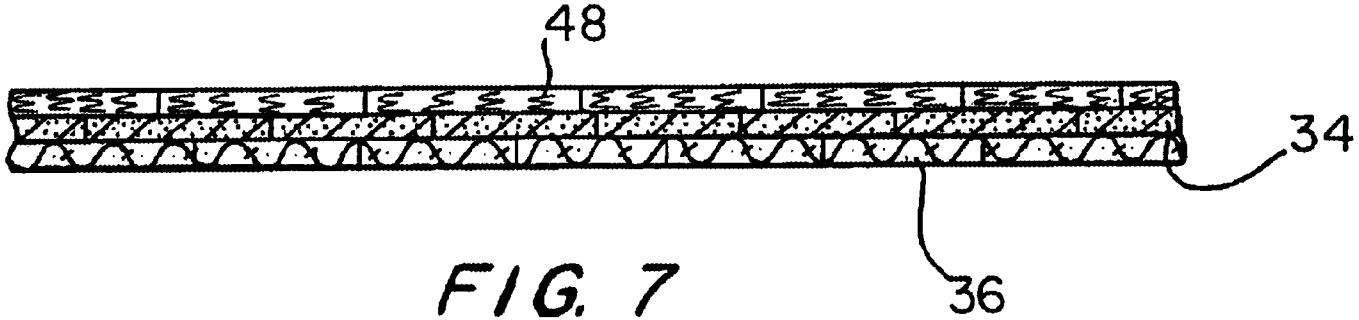
FIG. 7 is a cross-sectional view, analogous to that given in FIG. 5, of a third alternate embodiment of the present invention.
Figure 8:
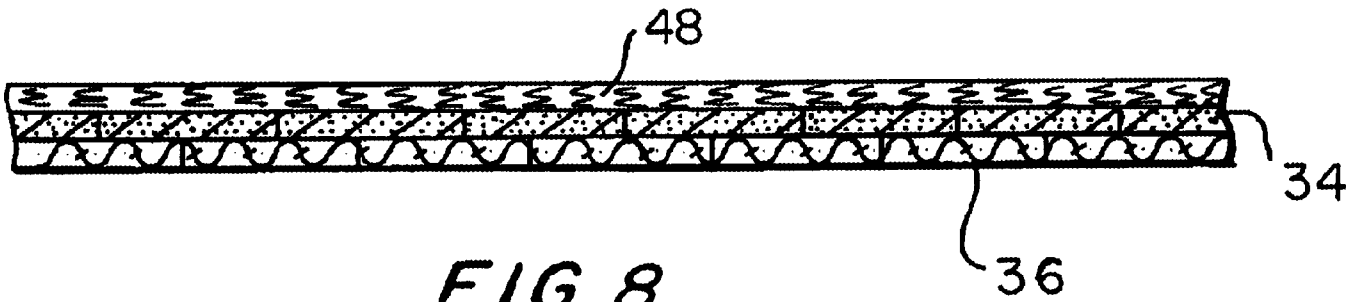
FIG. 8 is a cross-sectional view, also analogous to that given in FIG. 5, of a fourth alternate embodiment of the present invention.

In any event, whether the papermaker's fabric is laminated or comprises only one layer produced by spirally winding laminated structure 16, one or more layers of staple fiber material 48 may be applied to its outer surface, its inner surface, or to both of these surfaces, either in the form of a strip spiralled thereonto, as shown in FIG. 7, or full-width, as shown in FIG. 8, and driven thereinto by needling or hydroentangling. Where the papermaker's fabric has been laminated, individual fibers of the staple fiber material, driven through the overlying layers, are the primary means by which the layers are attached to one another. In any case, this additional batt improves the structural integrity of the papermaker's fabric and reduces the risk of sheet marking.

What is claimed is:

1. A method for manufacturing a papermaker's fabric, said method comprising the steps of:

providing a laminated structure, said laminated structure having a bottom layer and a top layer, said bottom layer and said top layer each being strips of equivalent width and being laminated together, said bottom layer being transversely offset with respect to said top layer so that an unlaminated portion of said bottom layer is along one lateral edge of said laminated structure and an unlaminated portion of said top layer is along the other lateral edge of said laminated structure;

spirally winding said laminated structure in a plurality of turns wherein said unlaminated portion of said top layer in one turn of said laminated structure overlies said unlaminated portion of said bottom layer in an adjacent turn of said laminated structure; and joining said overlying unlaminated portion of said top layer to said unlaminated portion of said bottom layer to form said papermaker's fabrics said joining including one or more operations selected from the group consisting of sewing, stitching, welding, needling, fusing and gluing said overlying unlaminated portion with said top layer to said unlaminated portion of said bottom layer, and said papermaker's fabric being in the form of an endless loop having an inner surface and an outer surface;

wherein the resulting papermaker's fabric has a sandwich structure, and wherein the surface of said top layer and the surface of said bottom layer that form the inner surfaces of said sandwich are substantially smooth.

2. A method as claimed in claim 1 wherein said step of providing a laminated structure comprises the steps of:

providing the bottom layer, said bottom layer being a base for said laminated structure;

providing the top layer, said top layer being adapted to support a paper web in a paper machine;

forming a sandwich of said top and bottom layers, said bottom layer being transversely offset with respect to said top layer; and attaching said top and bottom layers together to form said laminated structure.

3. A method as claimed in claim 2 wherein said step of attaching is performed by sewing.

4. A method as claimed in claim 2 wherein said step of attaching is performed by needling.

5. A method as claimed in claim 2 wherein said step of attaching is performed by gluing.

6. A method as claimed in claim 2 wherein said step of attaching is performed by fusing.

7. A method as claimed in claim 2 wherein said step of attaching is performed by melting.

8. A method as claimed in claim 1 further comprising the step of attaching at least one additional layer of staple fiber material to said papermaker's fabric.

9. A method as claimed in claim 8 wherein said attaching step is carried out on said inner surface of said papermaker's fabric.

10. A method as claimed in claim 8 therein said attaching step is carried out on said outer surface of said papermaker's fabric.

11. A method as claimed in claim 8 wherein said at least one additional layer of staple fiber material is in the form of a strip spiralled onto one of said inner and outer surfaces of said papermaker's fabric.

12. A method as claimed in claim 8 wherein said at least one additional layer of staple fiber material is applied full-width onto one of said inner and outer surfaces of said papermaker's fabric.

13. A method as claimed in claim 1 further comprising the step of providing a base fabric for said papermaker's fabric, said base fabric being in the form of an endless loop, said endless loop having an inner surface, an outer surface, a first and a second lateral edge, and a fabric width measured transversely between said lateral edges, wherein said laminated structure is spirally wound in a plurality of turns upon said outer surface of said base fabric.

14. A method as claimed in claim 1 further comprising the steps of:

providing a base fabric for said papermaker's fabric, said base fabric being in the form of an endless loop, said endless loop having an inner surface, an outer surface, a first and a second lateral edge, and a fabric width measured transversely between said lateral edges; and slipping said base fabric inside said papermaker's fabric.

15. A method as claimed in claim 1, wherein said laminated stricture is a first laminated structure, further comprising the steps of:

providing a second laminated structure, said second laminated structure also having a bottom layer and a top layer, said bottom layer and said top layer each being strips of equivalent width and being laminated together, said bottom layer being transversely offset with respect to said top layer so that an unlaminated portion of said bottom layer is along one lateral edge of said second laminated structure and an unlaminated portion of said top layer is along the other lateral edge of said second laminated structure;

spirally winding said second laminated structure in a plurality of turns upon said papermaker's fabric, wherein said unlaminated portion of said top layer in one turn of said second laminated structure overlies said unlaminated portion of said bottom layer in an adjacent turn of said second laminated structure; and joining said overlying unlaminated portion of said top layer to said unlaminated portion of said bottom layer.

16. A method as claimed in claim 15 wherein said second laminated structure is spirally wound in a direction opposite to that in which said first laminated structure is wound.

17. A papermaker's fabric for a paper machine, said papermaker's fabric comprising:

a laminated structure, said laminated structure having a bottom layer and a top layer, said bottom layer and said top layer each being strips of equivalent width and being laminated together, said bottom layer being transversely offset with respect to said top layer, so that an unlaminated portion of said bottom layer is along one lateral edge of said laminated structure and an unlaminated portion of said top layer is along the other lateral edge of said laminated structure; said laminated structure being spirally wound in a plurality of turns wherein said unlaminated portion of said top layer in one turn of said laminated structure overlies said unlaminated portion of said bottom layer in an adjacent turn of said laminated structure; said overlying unlaminated portion of said top layer being joined to said unlaminated portion of said bottom layer by performing one or more operations selected from the group consisting of sewing, stitching, welding, needling, fusing and gluing said overlying unlaminated portion of said top layer with said unlaminated portion of said bottom layer;

wherein the resulting papermaker's fabric has a sandwich structure, and wherein the surface of said top layer and the surface of said bottom layer that form the inner surfaces of said sandwich are substantially smooth.

18. A papermaker's fabric as claimed in claim 17 further comprising at least one additional layer of staple fiber material attached to one of the inner and outer surfaces of said papermaker's fabric.

19. A papermaker's fabric as claimed in claim 18 wherein said at least one additional layer of staple fiber material is in the form of a strip spiralled onto one of said inner and outer surfaces of said papermaker's fabric.

20. A papermaker's fabric as claimed in claim 18 wherein said at least one additional layer of staple fiber material is applied full-width onto one of said inner and outer surfaces of said papermaker's fabric.

21. A papermaker's is fabric as claimed in claim 17 further comprising a base fabric in the form of an endless loop, said endless loop having an inner surface and an outer surface, wherein said laminated structure is spirally wound upon said outer surface of said base fabric.

22. A papermaker's fabric as claimed in claim 17 further comprising a base fabric in the form of an endless loop, said endless loop having an inner surface and an outer surface, wherein said base fabric is inside said papermaker's fabric.

23. A papermaker's fabric as claimed in claim 17 wherein said laminated structure is a first laminated structure and further comprising a second laminated structure, said second laminated structure also having a bottom layer and a top layer, said bottom layer and said top layer each being strips of equivalent width and being laminated together, said bottom layer being transversely offset with respect to said top layer, so that an unlaminated portion of said bottom layer is along one lateral edge of said second laminated structure and an unlaminated portion of said top layer is along the other lateral edge of said second laminated structure; said second laminated structure being spirally wound in a plurality of turns upon said papermaker's fabric wherein said unlaminated portion of said top layer in one turn of said second laminated structure overlies said unlaminated portion of said bottom layer in an adjacent turn of said second laminated structure; said overlying unlaminated portion of said top layer being joined to said unlaminated portion of said bottom layer.

24. A papermaker's fabric as claimed in claim 17 wherein said top layer of said laminated structure comprises one of the materials selected from the group consisting of: staple fiber material; fabric woven from fibers or filaments; spun-bond, hydroentangled and melt-blown nonwoven fabrics; and apertured extruded polymeric films.

25. A papermaker's fabric as claimed in claim 17 wherein said top layer of said laminated structure comprises at least two distinct sublayers, each of said sublayers comprising one of the materials selected from the group consisting of: staple fiber material; fabric woven from fibers or filaments; spun-bond, hydroentangled and melt-blown nonwoven fabrics; and apertured extruded polymeric films.

26. A papermaker's fabric as claimed in claim 17 wherein said bottom layer of said laminated structure comprises one of the materials selected from the group consisting of: staple fiber material; fabric woven from fibers or filaments; spun-bond, hydroentangled and melt-blown nonwoven fabrics; apertured extruded polymeric films; knitted fabrics; nonwoven netting materials or mesh fabrics; and woven fabric strips.

27. A papermaker's fabric as claimed in claim 17 wherein said bottom layer of said laminated structure comprises at least two distinct sublayers, each of said sublayers comprising one of the materials selected from the group consisting of: staple fiber material; fabric woven from fibers or filaments; spun-bond, hydroentangled and melt-blown nonwoven fabrics; apertured extruded polymeric films; knitted fabrics; nonwoven netting materials or mesh fabrics; and woven fabric strips.

* * * * *